United States Patent [19]

Kimura et al.

[11] Patent Number: 4,530,588

[45] Date of Patent: Jul. 23, 1985

[54] MOUNT FOR A ROTATING DRUM AND A DEVELOPER WITHIN AN ELECTROSTATIC COPYING APPARATUS

[75] Inventors: Hiroshi Kimura, Habikino; Masahiko Hisajima; Kiyoshi Shibata, both of Osaka; Yoichiro Irie, Suita; Kiyoshi Morimoto, Osaka; Takashi Nagashima, Sakai; Yasuhiko Yoshikawa; Masahiro Watashi, both of Ikoma; Kiyonori Yamamoto, Neyagawa; Toshihiko Yamamoto, Takaishi; Shinsuke Yoshinaga, Sakai, all of Japan

[73] Assignee: Mita Industrial Co., Ltd., Japan

[21] Appl. No.: 475,671

[22] Filed: Mar. 15, 1983

[30] Foreign Application Priority Data

Apr. 19, 1982 [JP] Japan ..... 57-63863

[51] Int. Cl.[3] ..... G03G 15/00; G03G 21/00; G03G 15/30

[52] U.S. Cl. ..... 355/3 DR; 355/3 R; 355/3 DD; 355/10; 355/11; 118/621

[58] Field of Search ..... 355/3 DR, 3 DD, 3 R, 355/10, 11, 16; 118/621, 653

[56] References Cited

U.S. PATENT DOCUMENTS

| | | | |
|---|---|---|---|
| 3,600,082 | 8/1971 | Knechtel | 355/16 X |
| 3,600,083 | 8/1971 | Leedom | 355/10 |
| 3,698,804 | 10/1972 | Cranskens et al. | 355/11 X |
| 3,861,306 | 1/1975 | Du Bois et al. | 355/3 R X |
| 3,947,107 | 3/1976 | Smith | 118/621 X |
| 3,976,371 | 8/1976 | Moser et al. | 355/3 DD |
| 3,985,436 | 10/1976 | Tanaka et al. | 355/3 DD |
| 4,032,229 | 6/1977 | Tani et al. | 355/10 X |
| 4,165,168 | 8/1979 | Baumann et al. | 355/3 R |
| 4,185,907 | 1/1980 | Baier et al. | 355/3 R |
| 4,236,807 | 12/1980 | Kuehnle | 355/3 R |
| 4,270,856 | 6/1981 | Goida | 355/3 R |
| 4,286,861 | 9/1981 | Matsumoto et al. | 355/3 DD X |

*Primary Examiner*—A. T. Grimley
*Assistant Examiner*—Terry Flower
*Attorney, Agent, or Firm*—Beveridge, DeGrandi & Weilacher

[57] ABSTRACT

An electrostatic copying apparatus including a support frame having a front support wall and a rear support frame. The support frame is mounted on a housing slidably in the front and rear direction between an operating position within the housing and a pull-out position outside of the housing. A rotating drum and a developing device are mounted on the support frame. Each of the rear surface of the front support wall and the front surface of the rear support wall has a semicircular receiving portion with an open top, and each end of the rotating drum has a shaft bearing member with a circular peripheral surface. By inserting each bearing member into the associated receiving portion, the drum is rotatably mounted. The developing device has a front wall and a rear wall, with a projecting portion formed at the end of each. An abutting lower edge is defined on each projecting portion, and an abutting front edge is defined on each of the front wall and the rear wall, below the projecting portion. The developing device is mounted between the front support wall and the rear support wall with each abutting lower edge abutting against the upper surface of the associated bearing member when that associated bearing member is inserted into its associated receiving portion and with each abutting front edge abutting against the side surface of the associated receiving portion.

6 Claims, 10 Drawing Figures

74
M2
10
8
14
78
108
116
120
146
162
202
204
214
216
218
220
222
224
228
230
232
234
236
238
240
242
244
246
248
250
252
254
256
258
260
262
264
266

MOUNT FOR A ROTATING DRUM AND A DEVELOPER WITHIN AN ELECTROSTATIC COPYING APPARATUS

FIELD OF THE INVENTION

This invention relates to an electrostatic copying apparatus. More specifically, the invention relates to the mounting of a rotating drum and a developing device on a support frame slidably mounted on the housing of a copying apparatus, and to the structure of the developing device itself.

DESCRIPTION OF THE PRIOR ART

There has previously been known an electrostatic copying apparatus in which a support frame, having a rotating drum and a developing device mounted thereon, is mounted slidably on the housing of the copying apparatus in order to facilitate the inspection and repair of components of the apparatus. These components include the rotating drum, which has a photosensitive member thereon, and the developing device, which develops a latent electrostatic image. Further, this permits servicing of the apparatus, including, the removal of paper jamming in the housing of the copying apparatus and the supplying of toner particles to a toner particle supplier of the developing device. In this known electrostatic copying apparatus, it is the practice to position the support frame at a pull-out position outside the housing at the time of inspection or repair, to remove the developing device or the rotating drum from the support frame, and to inspect or repair the developing device or the rotating drum or to exchange the rotating drum with a new one. The operation of mounting or detaching the rotating drum or the developing device on or from the support frame is not easy, and various problems arise. For example, at the time of mounting or detaching the rotating drum, the photosensitive member on the surface of the rotating drum may undergo damage from contact with a part of the supporting frame or from touching of the band of a serviceman on the photosensitive member. Similarly, at the time of mounting or detaching the developing device, a part of the developing device may contact the photosensitive member on the rotating drum, or the hand of the service man may touch the photosensitive member to damage the photosensitive member. Furthermore, the operation of mounting or detaching the rotating drum and the developing device is complex.

It is well known to those skilled in the art that in an electrostatic copying apparatus, a good toner image cannot be obtained on the photosensitive member unless the distance between the surface of the photosensitive member, having a latent electrostatic image formed thereon, and the developing device for developing the latent electrostatic image (for example, when the developing device is a magnetic brush-type developing device, this distance is specifically the distance between the surface of the photosensitive member and a sleeve member holding a developer) is maintained strictly constant. It is important therefore to maintain the aforesaid distance always constant in the above operations of mounting the rotating drum and the developing device on the support frame. Thus, various electrostatic copying apparatuses have been proposed previously which facilitate the mounting or detaching of the rotating drum and the developing device on the support frame and which maintain the distance between the surface of the photosensitive member and the developing device always constant. However, none of these has proven to be entirely satisfactory. The mounting or detaching operation is still complex, or the distance between the surface of the photosensitive member and the developing device cannot be maintained always constant.

In an electrostatic copying apparatus, a developing device of the type wherein a so-called two-component developer, composed of carrier particles and toner particles, is used is generally in widespread use in order to develop a latent electrostatic image formed on a photosensitive member or a copying paper into a visible image. In such a type of developing device, the carrier particles and the toner particles are agitated in a developer receptacle, and the toner particles, charged by this agitating action, are applied to a latent electrostatic image by suitable means such as a magnetic brush mechanism.

The above-type conventional developing device itself has the following problem. When the copying process is repeated a number of times in the above-type of developing apparatus, the performance of the carrier particles in the developer is reduced. As a result, the toner particles are not fully charged, and a good toner image corresponding to the latent electrostatic image cannot be obtained. Hence, when the copying process has been repeated more than a predetermined number of times, the degraded carrier particles should be exchanged with new ones. If the developer receptacle for storing developer composed of carrier particles and toner particles has a small volume, the amount of the developer which can be contained therein is small (that is, the amount of both the carrier particles and the toner particles is small, while the mixing ratio of the carrier particles and the toner particles in the developer is maintained nearly constant). The small amount of the carrier particles leads to rapid degradation of the carrier particles and shortens their life. Therefore, the carrier particles should be exchanged frequently. Furthermore, when the amount of the toner particles is small, the mixing ratio between the carrier particles and the toner particles varies greatly as the toner particles are consumed during copying. Consequently, a good toner image corresponding to the latent electrostatic image cannot be obtained. It may be possible to increase the volume of the developer receptacle in order to increase the time interval between exchangings of the carrier particles and to reduce the variations in the mixing ratio of the carrier particles and the toner particles. If the volume of the developing receptacle is simply increased, the length of transportation of the developer from a developer removing zone of the magnetic brush mechanism to a developer pumping zone through the agitating mechanism becomes long, and during transportation, non-uniformity in the feeding of the developer occurs. This results in the occurrence of non-uniformity in the supplying of the developer to the magnetic brush mechanism, and a good toner image cannot be obtained.

SUMMARY OF THE INVENTION

It is a primary object of this invention, therefore, to provide an improved electrostatic copying apparatus in which a rotating drum and a developing device are mounted with simplicity and accuracy on a support frame mounted slidably on the housing of the copying apparatus, and the distance between the surface of a photosensitive member on the rotating drum and the developing device can always be maintained constant.

Another object of this invention is to provide an improved developing device in which a two-component developer composed of carrier particles and toner particles is used, the developer can be fully agitated in a developer receptacle of an increased volume, and the agitated developer can be stably supplied to a magnetic brush mechanism.

Other objects of this invention will become apparent from the following description taken in conjunction with the accompanying drawings.

According to the present invention, there is provided, in order to achieve the aforesaid primary object, an electrostatic copying apparatus of the type including a support frame having a front support wall and a rear support frame located with a predetermined space therebetween in the front and rear direction, the support frame being mounted on a housing defining the apparatus so that it is slidable in the front and rear direction between its operating position within the housing and its pull-out position forwardly of the housing, a rotating drum mounted on said support frame and having a photosensitive member disposed on its peripheral surface, and a developing device for developing a latent electrostatic image formed on the photosensitive member. Each of the rear surface of the front support wall and the front surface of the rear support wall in the support frame has a semicircular receiving portion having an open top, and each end of the rotating drum has mounted thereon a bearing member having a circular peripheral surface. By inserting each bearing member into the corresponding receiving portion from above, the rotating drum is rotatably mounted between the front support wall and the rear support wall of the support frame. The developing device has a front wall and a rear wall located with a predetermined space therebetween in the front and rear direction. A projecting portion is formed at the end of each of the front wall and the rear wall. An abutting lower edge is defined at the lower edge of each projecting portion. An abutting front edge is defined at the front edge, located below the projecting portion, of each of the front wall. The rear wall, and the developing device is mounted between the front support wall and the rear support wall by causing each abutting lower edge to abut against the upper surface of each bearing member inserted in each receiving portion and each abutting front edge to abut against the side surface of each receiving portion. As a result, each bearing member is prevented from moving away upwardly from each receiving portion, and the developing device is held at a predetermined position with respect to the rotating drum.

Furthermore, according to this invention, there is provided, to achieve the aforesaid other object, a developing device comprising a developer receptacle for storing a two-component developer composed of carrier particles and toner particles, a magnetic brush mechanism disposed in a front portion within the developer receptacle, a first agitating mechanism disposed in a rear portion within the developer receptacle in a spaced-apart relationship to the magnetic brush mechanism, a second agitating mechanism disposed in proximity to, and rearwardly or downwardly of, the magnetic brush mechanism, a developer removing member disposed between the magnetic brush mechanism and the first agitating mechanism with its front edge being in contact with, or in proximity to, the surface of the magnetic brush mechanism, and a toner particle supplier for supplying toner particles to the developer receptacle. A plurality of cuts spaced in the widthwise direction are formed at least in the front portion of the developer removing member, and a part of the developer held on the surface of the magnetic brush mechanism is removed therefrom by the action of the developer removing member and caused to flow over the upper surface of the developer removing member toward the first agitating mechanism, but the remainder of the developer held on the surface of the magnetic brush mechanism moves through the cuts without undergoing the action of the developer removing member and is caused to flow toward the second agitating mechanism.

DETAILED DESCRIPTION OF THE PREFERRED EMBODIMENTS

Preferred embodiments of the electrostatic copying apparatus constructed in accordance with this invention are described below with reference to the accompanying drawings.

Figure 1:
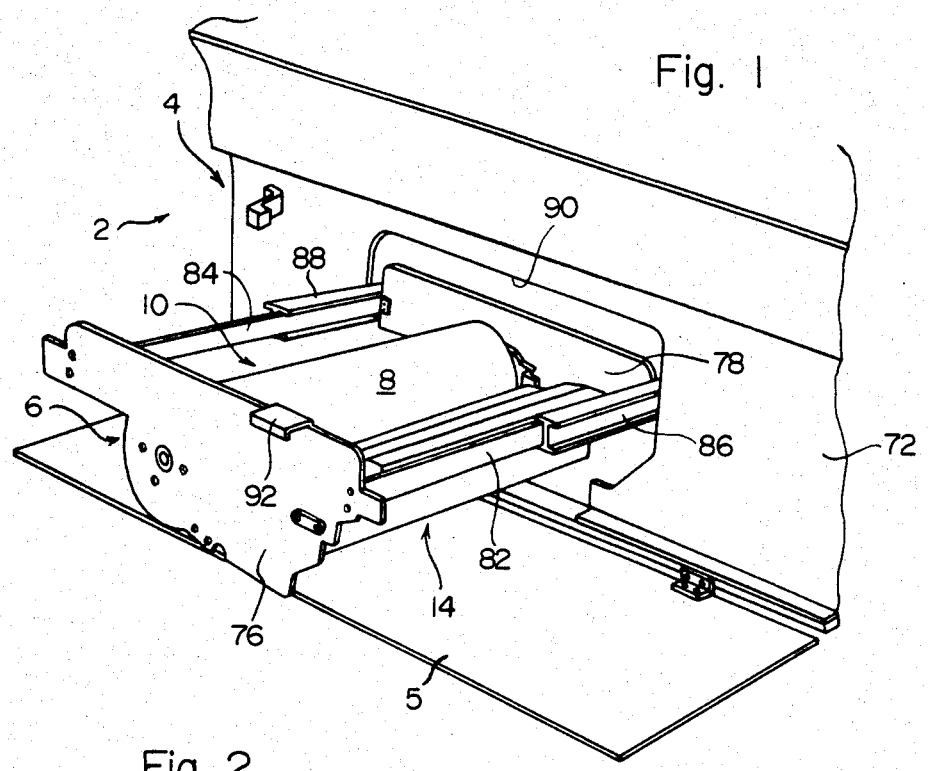
FIG. 1 is a fragmentary perspective view, of a part of a preferred embodiment of the electrostatic copying apparatus constructed in accordance with the invention.

The electrostatic copying apparatus generally shown at 2 in FIG. 1 has a housing 4. A front cover 5 is mounted on the front surface of the housing 4 so that it can pivot freely with its lower end as a center. (FIG. 1 shows the front cover 5 in its open position.) A support frame (to be described hereinafter), shown generally at 6, is slidably mounted on the housing 4, and a rotating drum 10, having a photosensitive member 8 disposed on at least a part of its peripheral surface (in the embodiment shown, over the entire periphery), is mounted on the support frame 6 so that it can revolve freely in the direction shown by arrow 12 (see FIG. 2). A developing device 14 is further mounted on the support frame 6 facing the rotating drum 10. The developing device 14 will be described in detail hereinbelow.

Figure 2:
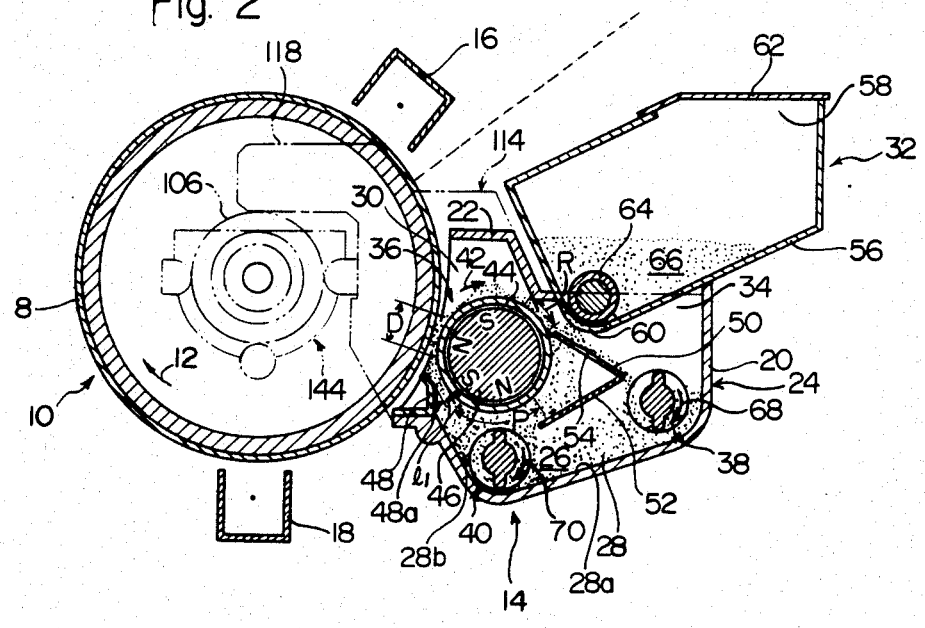
FIG. 2 is a sectional view showing the rotating drum and the adjacent components and the developing device in the electrostatic copying apparatus illustrated in FIG. 1.

Within the housing 4, a charging corona discharge device 16, for applying an electrostatic charge to the photosensitive member 8 on the rotating drum 10, a transfer corona discharge device 18, for transferring a toner image formed on the photosensitive member 8 by the action of the developing device 14 to a copying paper, and a cleaning device (not shown), for removing the toner image remaining on the photosensitive member 8 after the transfer, are disposed around the rotating drum 10 as shown in FIG. 2. Although not shown, an optical system, including an illuminating lamp, for projecting upon the photosensitive member 8 the image of a document placed on a transparent plate on the upper surface of the housing 4, is provided above the rotating drum 10 within the housing 4. In the lower portion of the housing 4 and below the rotating drum 10, there is provided a copying paper conveying system which conveys a copying paper to a site between the rotating drum 10 and the transfer corona discharge device 18 and discharges copying paper, having the toner image transferred thereto by the action of the transfer corona discharge device 18, out of the housing 4, and which includes a fixing device for fixing the toner image on the copying paper.

In the electrostatic copying apparatus 2 including the rotating drum 10 and the developing device 14, as the rotating drum 10 is rotated in the direction of arrow 12, an electrostatic charge is first applied to the photosensitive member 8 on the rotating drum 10 by the action of the charging corona discharge device 16, and the image of the document is projected on the charged photosensitive member 8 by the action of the optical system (not shown) to form a latent electrostatic image corresponding to the document. Thereafter, the latent electrostatic image is developed by the action of the developing device 14 to form a toner image corresponding to the document on the photosensitive member 8. The toner image on the photosensitive member 8 is then transferred to a copying paper conveyed by the paper conveying system (not shown) by the action of the transfer corona discharge device 18. The transferred toner image is fixed to the copying paper by the fixing device (not shown) and discharged out of the housing 4. On the other hand, the photosensitive member 8 on the rotating drum 10, after the transfer of the toner image, is cleaned by a cleaning device (not shown) to remove the toner remaining on the surface of the photosensitive member 8, and is again used in the next cycle of copying.

The developing device 14 improved in accordance with this invention will be described with reference to FIGS. 2 and 3. The developing device 14 has a development housing 24 defined by a lower main body 20 and an upper cover plate 22. As can be seen from FIG. 2, this development housing 24 constitutes a developer receptacle 28 for receiving a so-called two-component developer 26 composed of carrier particles and toner particles. An opening 30 is formed in the front surface of the development housing 24, and on the top surface of the development housing 24 is formed an opening 34 in which to mount a toner particle supplier 32 (to be described hereinafter). A magnetic brush mechanism 36, a first agitating mechanism 38 and a second agitating mechanism 40 are disposed within the development housing 24.

The magnetic brush mechanism 36 is comprised of a cylindrical sleeve member 44, to be rotated in the direction of arrow 42, and a roll-like stationary permanent magnet 46, disposed within the sleeve member 44, and is disposed in a front portion within the development housing 24, namely in a front portion within the developer receptacle 28. The roll-like stationary permanent magnet 46 in the illustrated embodiment has four magnetic poles spaced circumferentially on its peripheral edge, namely, alternately positioned, two N poles and two S poles.

The magnetic brush mechanism 36 magnetically holds a part of the developer 26 present in the developer receptacle 28 on the surface of the sleeve member 44 in a developer pumping zone P, located along and beneath the magnetic brush mechanism 36, by the action of a magnetic field generated by the stationary permanent magnet 46. By the rotation of the sleeve member 44, the magnetic brush mechanism 36 carries the developer 26 held on its surface to a development operation zone D. In the development operation zone D, the developer 26 held on the surface of the sleeve member 44 makes contact with the photosensitive member 8 on the rotating drum 10 rotating in the direction of arrow 12 through the opening 30 formed on the front surface of the development housing 24 (i.e., that surface which faces the surface of the rotating drum 10).

Between the developer pumping zone P and the development operation zone D is disposed a brush length setting member 48, spaced a predetermined distance from the surface of the sleeve member 44, to adjust the amount of the developer 26 carried to the development operation zone D while being held on the surface of the sleeve member 44, in other words the thickness of the layer of the developer 26, to a suitable value.

The corner portion 48*a* of the brush length setting member 48 is located in proximity to the surface of the sleeve member 44 at a predetermined distance $l_1$, and the brush length setting member 48 sets the length of a magnetic brush formed by the developer 26 held on the surface of the sleeve member 44 at a predetermined value. In order to adjust the distance $l_1$ as finely as required, the brush length setting member 48 is mounted at a required position in the development housing 24, more specifically at the front end portion of the lower main body 20, in such a manner that it can be finely adjusted to the left and right directions in FIG. 2, for example.

A developer removing zone R, where the developer 26 held on the surface of the sleeve member 44 is removed therefrom, exits downstream of the development operation zone D as viewed in the rotating direction of the sleeve member 44, i.e. in the direction of arrow 42, (nearly opposite to the development operation zone D of the sleeve member 44). The stationary permanent magnet 46 is not magnetized at a portion corresponding to the developer removing zone R, and, therefore, in this zone R, the magnetic field generated by the stationary magnet 46 is sufficiently weak or does not substantially exist. In the developer removing zone R, a developer removing member 50, having its front edge contacting or approaching the surface of the sleeve member 44, is provided, inclined downwardly in the rearward direction (right side in FIG. 2), and between the developer removing zone R and the developer pumping zone P and beneath the developer removing member 50 is provided a guide member 52 which is inclined downwardly in the forward direction (left side in FIG. 2).

Figure 3:
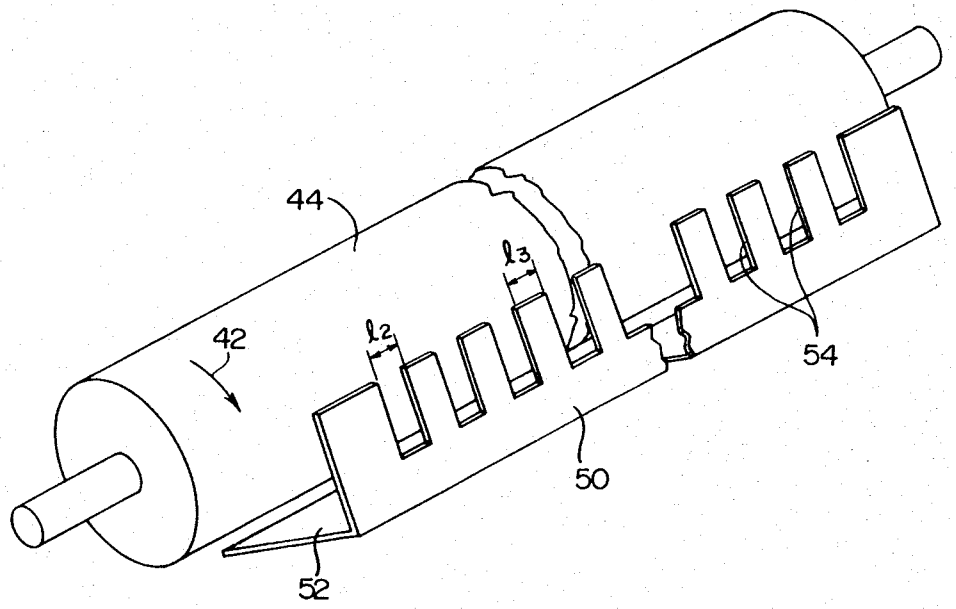
FIG. 3 is a perspective view of a magnetic brush mechanism, in the vicinity of a developer removing zone, in the developing device in the electrostatic copying apparatus shown in FIG. 1.

In the specific embodiment shown in FIGS. 2 and 3, the developer removing member 50 and the guide member 52 are integrally formed, but they may be constructed separately.

As shown on an enlarged scale in FIG. 3, a plurality of cuts 54 are formed in the front edge of the developer removing member 50. Each of these cuts is substantially rectangular, and they are formed substantially at equal intervals in the widthwise direction of the developer removing member 50. Preferably, the width $l_2$ of each cut is substantially equal to distance $l_3$ between adjacent cuts.

In the developer removing zone R, the magnetic field is sufficiently weak or substantially absent, and a part of the front edge of the developer removing member 50 acts on the developer 26 held on the surface of the sleeve member 44. Accordingly, a part of the developer 26 held on the surface of the sleeve member 44 is removed therefrom and caused to flow over the upper surface of the developer removing member 50 toward the first agitating mechanism 38 (to be described in detail hereinafter). The remainder of the developer held on the surface of the sleeve member 44 does not undergo the action of the developer removing member 50 but moves through the cuts 54, drops on the guide member 52, and thereafter flows on the upper surface of the guide member 52 toward the second agitating mechanism 40 (to be described in detail hereinafter).

A toner particle supplier 32 mounted on the opening 34 formed on the upper surface of the development housing 24, is disposed above the developer removing member 50. The toner particle supplier 32 has a main body 56 with an opening 58 formed at its top portion for receiving toner particles and an opening 60 formed at its bottom portion for discharging toner particles. A closure 62 for closing the toner receiving opening 58 is secured pivotally or detachably to the upper part of the toner supplier 32. On the other hand, the toner particle discharge opening 60 has disposed therein a toner particle supply roller 64 mounted rotatably on the main body 56 of the supplier. The supply roller 64 may have a plurality of grooves or depressions formed on its surface by knurling, etc., or it may be a porous, spongy roller. The supply roller 64 is rotated by a suitable drive means $M_1$ (FIG. 4) such as an electric motor mounted on the main body 56, whereby toner particles 66 in the toner particle supplier 32 are discharged and supplied to the upper surface of the developer removing member 50 within the developer receptacle 28. The toner supply roller 64 is rotated for a predetermined period of time, according, for example, to the performance of a copying process or to the amount of the toner particles 66 in the developer receptacle 28 which have been consumed, and supplies a required amount of the toner particles 66 to the developer receptacle 28. When the toner particles 66 are supplied to the upper surface of the developer removing member 50 from the toner supplier 32, they are partly caused to flow on the upper surface of the developer removing member 50 toward the first agitating member 38 (which is described in detail hereinbelow). The remainder of the toner particles 66 move through the cuts 54 formed in the developer removing member 50, drop on the guide member 52, and thereafter flow over the upper surface of the guide member 52 toward the second agitating mechanism 40 (which is described in detail hereinafter).

The first agitating mechanism 38 and the second agitating mechanism 40 will be described below in detail. As shown in FIG. 2, the first agitating mechanism 38 is disposed in a rear portion of the development housing 24, i.e. the inside of the developer receptacle 28 (rearwardly of the magnetic brush mechanism 36 and the developer removing member 50) some distance from the magnetic brush mechanism 36 (within this space are provided the developer removing member 50 and the guide member 52).

The first agitating mechanism 38 is of a known structure and is rotated in the direction of arrow 68 in relation to the rotation of the sleeve member 44. The first agitating mechanism 38 mixes and agitates the developer 26 removed and placed onto the upper surface of the developer removing member 50 in the developer removing zone R and the toner particles 66 supplied to the upper surface of the developer removing member 50 from the toner particle supplier 32, to mix the carrier particles and the toner particles in the developer 26 uniformly, and triboelectrically charges the toner particles and supplies the mixture to the second agitating mechanism 40.

The second agitating mechanism 40 is disposed in proximity to, and beneath, the magnetic brush mechanism 36 provided in a front portion in the inside of the developer receptacle 28. The second agitating mechanism 40 is of a known structure, and is rotated in the direction shown by arrow 70 in relation to the rotation of the sleeve member 44. The second agitating mechanism 40 mixes and agitates the developer 26 which arrives there after it has moved from the surface of the sleeve member 44 through the cuts 54 of the developer removing member 50 without undergoing the action of the developer removing member 50, dropped onto the guide member 52 and caused to flow on the upper surface of the guide member 52, the toner particles 66 which arrive there after they have been discharged from the toner particle supplier 32, moved through the cuts 54 of the developer removing member 50 without undergoing the action of the developer removing member 50, then dropped onto the guide member 52 and caused to flow on the upper surface of the guide member 52, and the developer 26 which has been supplied by the action of the first agitating mechanism 38, to mix the carrier particles and the toner particles in the developer 26 uniformly and triboelectrically charge the toner particles. Then, the second agitating mechanism 40 supplies the mixture to the developer pumping zone P of the magnetic brush mechanism 36.

The second agitating mechanism 40 performs the aforesaid action, and for this reason, it is not always necessary that the second agitating mechanism 40 be disposed below the magnetic brush mechanism 36. It may be disposed at a suitable position in proximity to, and rearwardly of (opposite to the rotating drum 10 with respect to the magnetic brush mechanism 36), or downwardly of, the magnetic brush mechanism 36.

Preferably, the bottom surface of the development housing 24 (i.e. the developer receptacle 28), the magnetic brush mechanism 36, the second agitating mechanism 38, and the brush length setting member 48 mounted on the development housing 24 are constructed as illustrated in FIG. 2. The magnetic brush mechanism 36 is such that the developer pumping zone P is formed along and below it. The bottom surface of the developer receptacle 28 is inclined upwardly from the developer pumping zone P forwardly (to the left in FIG. 2) and rearwardly (to the right in FIG. 2). The second agitating mechanism 40 is disposed below the magnetic brush mechanism 36. Furthermore, it is preferred that downstream of the developer pumping zone P (downstream with respect to the rotating direction of the sleeve member 44), the brush length setting member 48 is spaced a predetermined distance from the surface of the magnetic brush mechanism 36. According to the above construction, the developer 26 flowing from the first agitating mechanism 38 toward the second agitating mechanism 40 moves downwardly over the inclined surface 28*a* of the bottom of the developer receptacle 28. The excess of the developer 26 cut off by the brush length setting member 48 is removed from the surface of the sleeve member 44, and caused to flow downwardly over the inclined surface 28*b* of the bottom of the developer receptacle 28 to the second agitating mechanism 40. Thus, the developer 26 does not stay at the bottom surface of the developer receptacle 28, and can be caused to flow stably toward the second agitating mechanism 40. As a result, the developer 26 from the first agitating mechanism 38, the developer 26 removed by the brush length setting member 48 and the developer 26 flowing over the surface of the guide member 52 can be agitated and mixed by the second agitating mechanism 40 and supplied to the magnetic brush mechanism 36 located above.

The operation and advantage of the developing device 14 illustrated above will be described. The developing device 14 performs the following actions as the sleeve member 44 rotates in the direction of arrow 42.

First, in the developer pumping zone P, the developer 26 agitated and supplied by the second agitating mechanism 40 is attracted to, and held on, the surface of the sleeve member 44 by the magnetic attracting force of the stationary permanent magnet 46, whereby a magnetic brush is formed on the surface of the sleeve member 44. Then, the length of the magnetic brush is adjusted to a predetermined value by the action of the brush length setting member 48 located in proximity to the surface of the sleeve member 44 at a distance $l_1$. The excess of the developer 26 flows over the inclined surface 28*b* of the bottom of the developer receptacle 28 toward the second agitating mechanism 40. Thereafter, in the development operation zone D, the magnetic brush contacts the surface of the photosensitive member 8 of the rotating drum 10 rotating in the direction of arrow 12, and consequently toner particles in the magnetic brush are applied to a latent electrostatic image formed, as described above, on the photosensitive member 8 to develop it to a visible image (toner image). In the developer removing zone R, the magnetic field is sufficiently weak or substantially absent, and a part of the front edge of the developer removing member 50 acts on the developer held on the surface of the sleeve member 44. Accordingly, in the developer removing zone R, after the above developing action, a part of the developer 26 held on the surface of the sleeve member 44 is removed therefrom and flows over the surface of the developer removing member 50 toward the first agitating mechanism 38, but the remainder of the developer 26 held on the surface of the sleeve member 44 moves through the cuts 54 of the developer removing member 50 without undergoing the action of the developer removing member 50, drops onto the guide member 52 and then flows over the guide member 52 toward the second agitating mechanism 40. Then, the developer 26 flowing over the surface of the developer removing member 50 is agitated and charged in the first agitating mechanism 38, and by the action of the first agitating mechanism 38, flows over the inclined surface 28*b* of the bottom of the developer receptacle 28 toward the second agitating mechanism 40. In the meantime, the developer 26 flowing over the surface of the guide member 52 is agitated and mixed with the developer 26 flowing over the inclined surface 28*a* of the bottom of the developer receptacle 28 and the developer 26 flowing over the inclined surface 28*b* of the bottom of the developer receptacle 28 and charged in the second agitating mechanism 40, and then the mixture is sent to the developer pumping zone P.

As stated hereinabove, in the developing device 14, the developer removed in the developer removing zone R is partly sent to the second agitating mechanism 40 through the surface of the developer removing member 50, the first agitating mechanism 38 and the inclined surface 28*a* of the bottom surface (constituting a relatively long supply passage for the developer 26), but the remainder is sent to the second agitating mechanism 40 through the cuts 54 of the developer removing member 50 and the upper surface of the guide member 52 (constituting a relatively short supply passage for the developer 26). Hence, even if non-uniformity occurs in the supplying of the developer 26 through the relatively long supply passage, non-uniformity in the supplying of the developer 26 to the second agitating mechanism 40, i.e., to the developer pumping zone P of the magnetic brush mechanism 36, can be reduced as compared with the prior art because the developer 26 is also sent to the second agitating mechanism 40 through the relatively short supply passage. Consequently, the developing action of the magnetic brush mechanism 36 is made generally uniform.

On the other hand, when the toner particle supply roller 64 is rotated for a predetermined period of time during the performance of the copying process, toner particles 66 in the toner particle supplier 32 are discharged onto the upper surface of the developer removing member 50 in the developer receptacle 28. The toner particles 66 so discharged are partly sent to the second agitating mechanism 40 through the upper surface of the developer removing member 50, the first agitating mechanism 38, and the inclined surface 28*a* on the bottom surface (constituting a relatively long supply passage for the developer 26). The remainder of the toner particles 66 are sent to the second agitating mechanism 40 through the cuts 54 of the developer removing member 50 and the upper surface of the guide member 52 (constituting a relatively short supply passage for the developer 26). Thus, fresh toner particles 66 are respectively supplied to the developer 26 in the relatively long supply passage and to the developer 26 in the relatively short supply passage, from both of which toner particles have been consumed in the development operation zone D. For this reason, the mixing ratio of carrier particles and toner particles in the developer 26 on the relatively long supply passage can be made nearly equal to the mixing ratio of carrier particles and toner particles in the developer 26 on the relatively short supply passage, and even if non-uniformity should occur in the supplying of the developer on the relatively long supply passage, the mixing ratio between carrier particles and toner particles in the developer 26 sent to the second agitating mechanism 40, i.e., to the developer pumping zone P of the magnetic brush mechanism 36, can be made nearly uniform.

In the illustrated embodiment, rectangular cuts 54 are formed on the front edge of the developer removing member 50. The cuts may be of other suitable shapes such as a semi-circular, triangular or pentagonal shape. In this case, it is preferred that the width of each cut at the front edge of the developer removing member 50 contacting or approaching the sleeve member 44 be made substantially equal to the distance between adjoining cuts at the front edge. Furthermore, in the illustrated embodiment, the guide member 52 is provided in order to conduct the developer 26 removed from the surface of the sleeve member 44 through the cuts 54 of the developer removing member 50 to the second agitating mechanism 40. The guide member 52 is not absolutely necessary and may be omitted if the developer 26 can be accurately supplied to the second agitating mechanism 40.

Now, with reference to FIGS. 1, 2 and 4 to 8, the mounting of the rotating drum 10 and the developing device 14 on the support frame 6 will be described.

Figure 4:
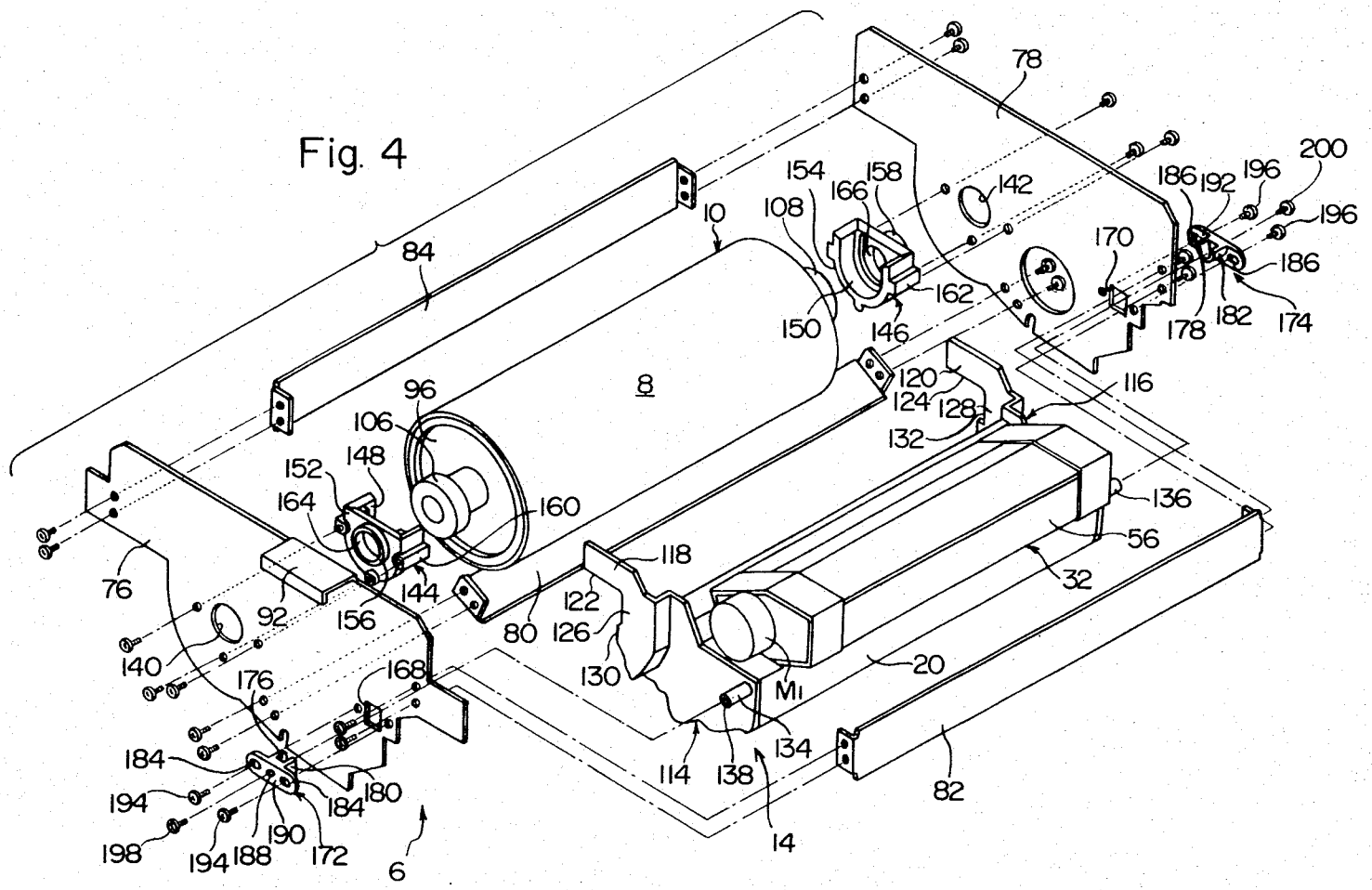
FIG. 4 is an exploded perspective view showing the support frame in the electrostatic copying apparatus shown in FIG. 1.
Figures 5, 6:
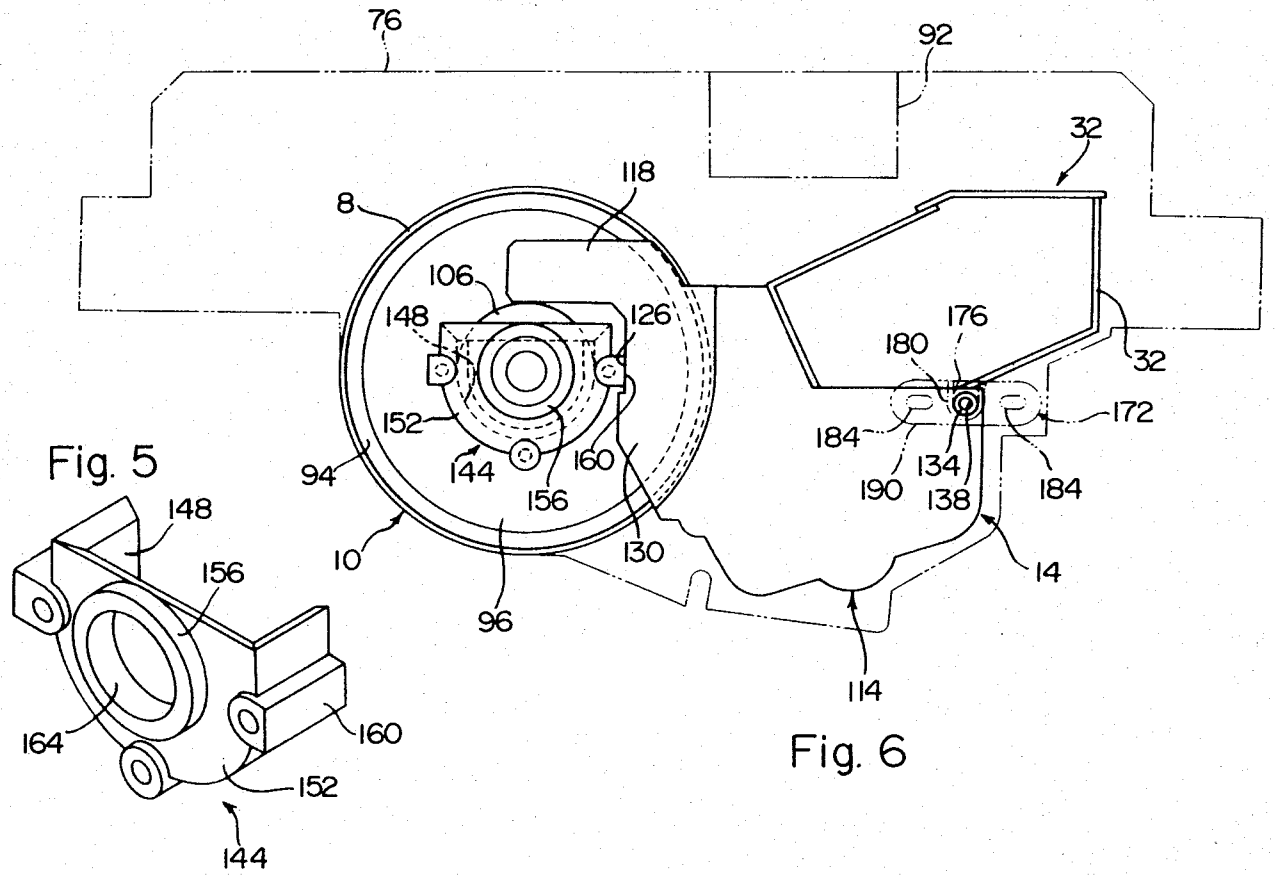
FIG. 5 is an enlarged perspective view showing a receiving member of the type mounted on the support frame shown in FIG. 4.
FIG. 6 is a front elevational view showing the mounting of a rotating drum and a developing device on the support frame shown in FIG. 4.

First, with reference to FIGS. 1, 4 and 6, the support frame 6 includes a front support wall 76 and a rear support wall 78 located substantially horizontally with a predetermined space therebetween in the front and rear direction (the direction from the left bottom toward the right top in FIG. 4; the direction perpendicular to the sheet surface in FIG. 6), which space nearly corresponds to the space between a vertical front base plate 72 (FIG. 1) and a vertical rear base plate 74 (FIGS. 8 and 9) of the housing 4 of the copying apparatus. Support frame 6 further includes horizontal members 80, 82 and 84 fixed between the front support wall 76 and the rear support wall 78. To the horizontal members 82 and 84 of the support frame 6 are respectively mounted guide rails 86 and 88 (FIG. 1) to be engaged slidably in the front and rear direction with a pair of guide rails (not shown) mounted in the housing 4 of the copying apparatus. The vertical front base plate 72 has formed therein an opening 90 having a shape corresponding to the shape of the support frame 6. Accordingly, the support frame 6 is mounted for free sliding in the front and rear direction through the opening 90 between its predetermined operating position within the housing 4 and its predetermined pull-out position (the position shown in FIG. 1) away from the housing 4 of the copying apparatus. The front support wall 76 further has a grip portion 92 at its upper end portion for facilitating the operation of pulling out the support frame 6. The front support wall 76 (for example, the grip portion 92) has provided therein a known locking means (not shown) which engages with a part of the vertical front base plate 72 elastically and releasably when the support frame 6 has been inserted to the predetermined operating position at which the front support wall 76 is substantially on the same plane as the vertical front base plate 72 and the rear support wall 78 adjoins the vertical rear base plate 74.

The rotating drum 10 and the developing device 14 are mounted on the support frame 6 described above.

Figure 7:
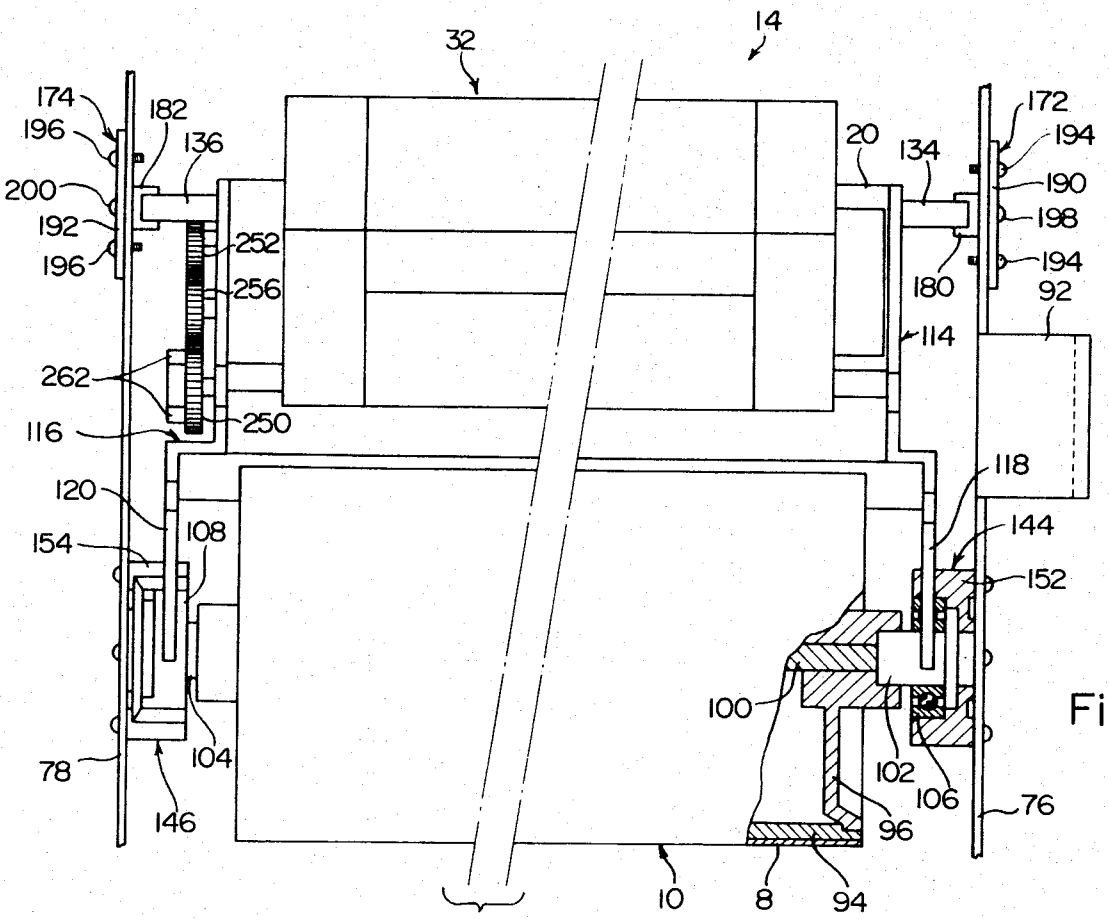
FIG. 7 is a partly broken-way sectional view showing the mounting of a rotating drum and a developing device on the support frame shown in FIG. 4.
Figure 8:
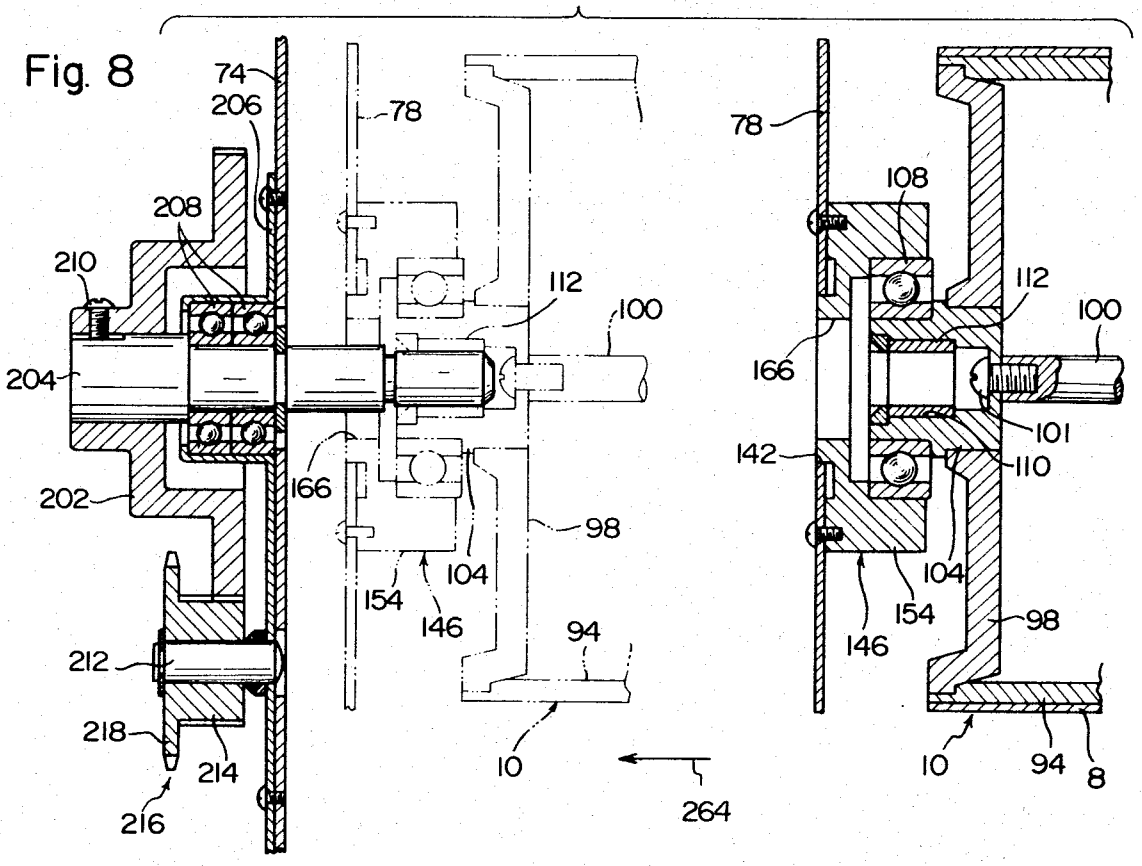
FIG. 8 is a fragmentary sectional view showing a drive means for the rotating drum of the electrostatic copying apparatus shown in FIG. 1 and the rear end portion of the rotating drum.

With reference to FIGS. 4, 6, 7 and 8, especially FIGS. 7 and 8, the rotating drum 10 has a cylindrical body 94 having a photosensitive member 8 on its surface, discs 96 and 98 mounted on the opposite end portions of the cylindrical body 94, and a supporting stay 100. The cylindrical body 94, having the photosensitive member 8, is held at a predetermined position when the discs 96 and 98 and the supporting stay 100 are positioned about it with the discs 96 and 98 fixed by screws 101 (only one of which is shown in FIG. 8) to the supporting stay 100 through the boss portions 102 and 104 of the discs 96 and 98. Known bearing members 106 and 108, having a circular peripheral surface, are mounted respectively on the boss portions 102 and 104 of the discs 96 and 98. A linking hole 110, extending forwardly from the rear end surface of the boss portion, is formed in the boss portion 104 at the rear end portion of the rotating drum 10, and a linking clutch 112, for transmitting the driving force from a drive means (to be described hereinafter) to the rotating drum 10, is mounted within the linking hole 110. This linking clutch 112 is a known one-way clutch which transmits only the driving force in a predetermined direction from the driving means to the rotating drum 10.

As shown in FIGS. 4, 6 and 7, the developing device 14 includes a front wall 114 and a rear wall 116 located with a predetermined space therebetween in the front and rear direction. In the illustrated embodiment, the front wall 114 and the rear wall 116 constitute the front side plate and rear side plate of the development housing 24. If desired, they may be made separately from the housing 24, and fixed respectively to the front and rear side plates of the housing 24. Projecting portions 118 and 120 are formed respectively at the ends of the front wall 114 and the rear wall 116. Substantially horizontally extending abutting lower edges 122 and 124 are defined respectively at the lower edges of the projecting portions 118 and 120. Furthermore, substantially vertically extending abutting front edges 130 and 132 are defined at front edges 126 and 128 located below the projecting portions 118 and 120 of the front wall 114 and the rear wall 116. Mounting projections 134 and 136, each having a circular peripheral surface at its rear end portion (opposite to the projecting portions 118 and 120), are provided respectively on the front surface of the front wall 114 and the rear surface of the rear wall 116, and threaded portions 138 (only one of them is shown in the drawings) are formed respectively at the tip portions of the mounting projections 134 and 136.

As shown in FIG. 4, the front support wall 76 and the rear support wall 78 of the support frame 6 have formed at a nearly central position thereof circular openings 140 and 142 respectively, and receiving members 144 and 146 are mounted on the circular openings 140 and 142 respectively. The receiving member 144, which is typical of members 144 and 146, is shown on an enlarged scale in FIG. 5. Receiving portions 144 and 146 have main portions 152 and 154 having formed therein upwardly opened semicircular receiving portions 148 and 150 respectively and position-setting projecting portions 156 and 158 having formed therein circular peripheral surfaces corresponding respectively to the circular openings 140 and 142. The position-setting projecting portions 156 and 158 are inserted into the circular openings 140 and 142 respectively to fix the receiving portions 144 and 146 to the rear surface of the front support wall 76 and to the front surface of the rear support wall 78, respectively. Hence, the receiving members 144 and 146 are mounted at predetermined positions of the front support wall 76 and the rear support wall 78, respectively to define receiving portions for the bearing members 106 and 108, respectively, at the rear surface of the front support wall 76 and the front surface of the rear support wall 78. The receiving members 144 and 146 have substantially vertical abutting surfaces 166 and 162 on their outside surfaces (in the illustrated embodiment, the outside surfaces of the main portions 152 and 154), against which surfaces the abutting front edges 130 and 132, defined in the developing device 14, abut. At the same time, through openings 164 and 166, extending in the front and rear direction, are formed in the position-setting projecting portions 156 and 158. The opening 164 in the position-setting projecting portion 156 may be omitted.

The front support wall 76 and the rear support wall 78 respectively have rectangular openings 168 and 170 formed at predetermined positions of their rear end portions (right bottom side in FIG. 4), and projecting receiving members 172 and 174 are mounted, respectively, on the openings 168 and 170. The projecting receiving members 172 and 174, respectively, include main portions 180 and 182 having formed therein upwardly opened semicircular projecting receiving portions 176 and 178 and fixing main bodies 190 and 192 having long slots 184 and 186, formed at opposite end portions, and a through hole 188, formed at their center, and the main portion 180 and 182 are inserted from outside into the rectangular openings 168 and 170 and fixed to the front support wall 76 and the rear support wall 78. Hence, the projecting receiving members 172 and 174 are mounted in predetermined positions on the front support wall 76 and the rear support wall 78 to define projecting receiving portions for the mounting projections 134 and 136 of the developing device 14 at the rear surface of the front support wall 76 and the front surface of the rear support wall 78. The main portions 180 and 182 of the projecting receiving members 172 and 174 can move horizontally within the rectangular openings 168 and 170. They can also move horizontally with respect to fixing screws 194 and 196 for fixing the projecting receiving members 172 and 174 to the front support wall 76 and the rear support wall 78. Hence, the projecting receiving members 172 and 174 can be freely adjusted horizontally in position with respect to the front support wall 76 and the rear support wall 78.

The rotating drum 10 and the developing device 14 are mounted on the support frame 6 in the following manner.

With reference to FIGS. 1, 4 and 6 to 8, in mounting the rotating drum 10 and the developing device 14, the first operation is to hold the support frame 6 at a predetermined pull-out position (shown by a solid line in FIGS. 1 and 8) pulled away from the housing 4 of the copying apparatus. Then, the bearing members 106 and 108 mounted on the opposite end portions of the rotating drum 10 are inserted from above into receiving portions provided at the rear surface of the front support wall 76 and the front surface of the rear support wall 78, more specifically into the receiving portions 148 and 150 of the receiving members 144 and 146 which are mounted on the front support wall 76 and the rear support wall 78. As a result, the rotating drum 10 is prevented from moving in the downward direction, the front and rear direction and the left and right direction by the receiving members 144 and 146, and the rotating drum 10 is mounted rotatably between the front support wall 76 and the rear support wall 78, i.e. on the support frame 6.

Then, in this state, the mounting projections 134 and 136, provided on the developing device 14, are inserted from above into receiving portions provided on the rear surface of the front support wall 76 and the front surface of the rear support wall 78, more specifically into the projecting receiving portions 176 and 178 of the projecting receiving members 172 and 174 mounted on the front support wall 76 and the rear support wall 78. As a result, the mounting projections 134 and 136 are mounted on the projecting receiving portions 176 and 178 respectively, and the abutting lower edges 122 and 124 of the projecting portions 118 and 120 of the front wall 114 and the rear wall 116 of the developing device 14 are caused to abut against the upper surfaces of the bearing members 106 and 108 of the rotating drum 10. Furthermore, the abutting front edges 130 and 132 at the front edges 126 and 128 of the front wall 114 and the rear wall 116 respectively are caused to abut against the abutting surfaces 160 and 162 formed on the outside surfaces of the receiving members 144 and 146. Consequently, the developing device 14 is mounted between the front support wall 76 and the rear support wall 78, i.e. on the support frame 6. When the developing device 14 is mounted on the support frame 6, the abutting lower edges 122 and 124 of the front wall 114 and the rear wall 116 abut against the upper surfaces of the bearing members 106 and 108 of the rotating drum 10 respectively. Accordingly, by the weight of the developing device 14, each of the bearing members 106 and 108, i.e. the rotating drum 10, is prevented from moving upwardly away from the receiving portions 148 and 150 of the receiving members 144 and 146. In addition, since the abutting front edges 130 and 132 of the front wall 114 and the rear wall 116 are caused to abut against the abutting surfaces 160 and 162 of the receiving members 144 and 146, the front wall 114 and the rear wall 116 (therefore the developing device 14) are positioned accurately with respect to the rotating drum 10.

In the illustrated embodiment, fixing screws 198 and 200 are applied to the threaded portions 138 of the mounting projections 134 and 136 of the developing device 14 through the through-holes 188 of the projecting receiving members 172 and 174 in order to prevent the developing device 14 from moving in the up-and-down direction after the mounting of the developing device 14.

In order to detach the rotating drum 10 and the developing device 14 from the supporting frame 6, the fixing screws 198 and 200 are removed, the developing device 14 is detached upwardly, and then the rotating drum 10 is detached upwardly.

Now, with reference to FIGS. 7 to 10, the driving means for driving the rotating drum 10 and the developing device 14 will be described.

Figures 9, 10:
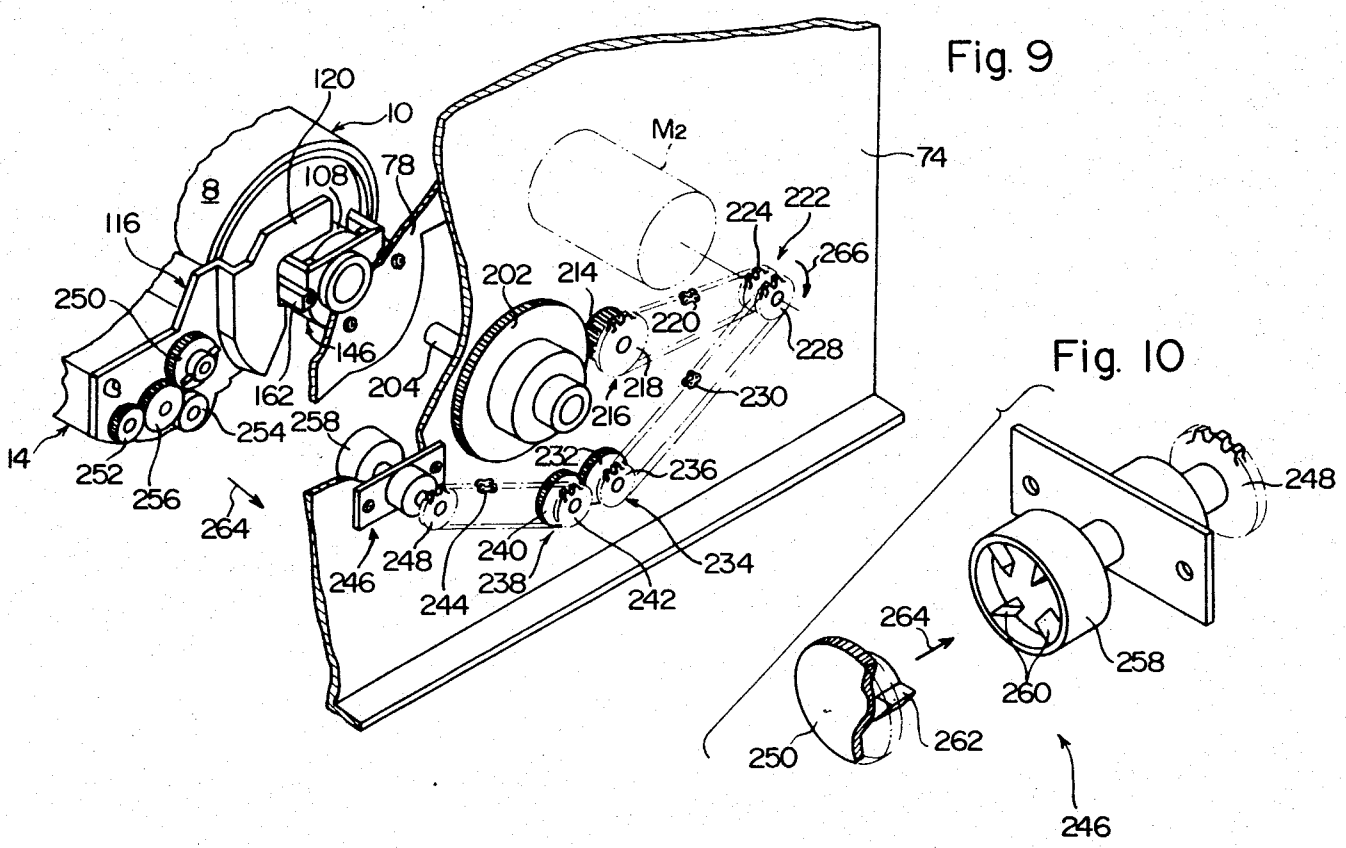
FIG. 9 is a fragmentary and broken-away sectional view showing a drive means mounted on the rear surface of each of a vertical rear base plate and rear wall in the electrostatic copying apparatus shown in FIG. 1.
FIG. 10 is an enlarged perspective view showing a linking clutch member of the drive means shown in FIG. 9.

The driving means for the rotating drum 10 has a large gear 202 and an input shaft 204 for driving the rotating drum 10. As clearly shown in FIG. 8, the input shaft 204 is rotatably mounted at its nearly central portion on a holding member 206 fixed to the vertical rear base plate 74 of the housing 4 of the copying apparatus, through the bearing members 208 (two bearing members in the illustrated embodiment). Its front end portion extends forwardly (to the right in FIG. 8) beyond the vertical rear base plate 74, and its rear end portion extends rearwardly (to the left in FIG. 8) from the vertical rear base plate 74. The large gear 202 is fixed to the rear end portion of the input shaft 204 by means of a fixing screw 210. To the front end portion of the input shaft 204 is drivingly connected the linking clutch 112 mounted on the boss portion 104 of the rotating drum 10. One end portion of a shaft member 212 is fixed to the holding member 206, and a linking sprocket 216 having a linking gear 214 is rotatably mounted on the shaft member 212. As shown in FIG. 9, the linking gear 214 of the linking sprocket 216 is drivingly connected to the large gear 202. The sprocket 218 is connected to one sprocket member 224 of a driving two-membered sprocket 222, fixed to the output shaft of a driving motor $M_2$ as a drive source, through an endless chain 220. Hence, the driving force of the driving motor $M_2$ rotating in the direction of arrow 226 (FIG. 9) is transmitted to the input shaft 204 through the driving two-membered sprocket 222, the endless chain 220, the linking sprocket 216 and the large gear 202.

The other sprocket member 228 of the driving two-membered sprocket 222 is connected to a sprocket 236 of a linking sprocket 234, having a linking gear 232, through an endless chain 230. The linking gear 232 of the linking sprocket 234 is connected to a sprocket 248 fixed to the input-side shaft of the linking clutch 246 through a linking gear 240 and a sprocket 242 of a linking sprocket 248 and an endless chain 244. Hence, the driving force of the driving motor $M_2$ is transmitted to the input side of a linking clutch member 246 through the driving two-membered sprocket 222, the endless chain 230, the linking sprocket 234, the linking sprocket 238, the endless chain 244 and the sprocket 248. The driving means for the developing device 14 is linked to the output side of the linking clutch 246. The driving means for the developing device 14 includes a gear 250 connected to the sleeve member 44, a gear 252 connected to the first agitating mechanism 38 and a gear 254 connected to the second agitating mechanism 40, all of which gears are rotatably mounted on the rear wall 116 of the developing device 14. The output side of the linking clutch member 246 is formed integrally on the side surface of the gear 250, and gears 252 and 254 are drivingly connected to the gear 250 through an idle gear 256. Accordingly, when the input side and the output side of the linking clutch member 246 are connected, the driving force of the input side is transmitted to the gears 252 and 254 through the gears 250 and 256.

As shown enlarged in FIG. 10, the input side of the linking clutch member 246 is constructed of a cylindrical main body 258 formed integrally with the input shaft to which the sprocket 248 is fixed, and a plurality of input-side engaging pieces 260 (four pieces in the illustrated embodiment) formed on the inner circumferential surface of the main body 258, and its output side is constructed of output-side engaging pieces 262 (two pieces in the illustrated embodiment) formed on the side surface of the gear 250 and cooperating with the engaging pieces 260. In order to facilitate connection between the input side and the output side, each of the input-side engaging pieces 260 and the output-side engaging pieces 262 is formed in such a manner that the surface which is opposite to the abutting surface, for transmitting the driving force upon abutting, is inclined in a predetermined direction.

When in the electrostatic copying apparatus 2 having the aforesaid driving means, the front surface cover 5 of the copying apparatus 2 is opened downwardly and the support frame 6 is caused to slide forwardly in a direction opposite to the direction shown by arrow 264 (FIGS. 8 and 9) to position the support frame 6 at the predetermined pull-out position (the position shown by a solid line in FIG. 8 and also in FIGS. 1 and 9) pulled out from the housing 4 of the copying apparatus, in order, for example, to inspect or repair the machine, the linking of the linking clutch 112 of the rotating drum 10 with the front end portion of the input shaft 204 is released, and the linking of the input side of the linking clutch member 246 with its output side is also released. Therefore, the driving force of the driving motor $M_2$ is not transmitted to the rotating drum 10 and the developing device 14.

On the other hand, when the support frame 6 is caused to slide from the predetermined pull-out position rearwardly, i.e. in the direction shown by arrow 264 (FIGS. 8 and 9), and held at the predetermined operating position (shown by a two-dot chain line in FIG. 8) within the housing 4 of the copying apparatus, the front end portion of the input shaft 204 is received in the linking hole 110 of the boss member 104 through the opening 166 of the receiving member 146, and the input shaft 204 is drivingly connected to the rotating drum 10 through the linking clutch 112 mounted in the linking hole 110. Moreover, the input-side engaging pieces 260 and the output-side engaging pieces 262 of the linking clutch member 246 are linked to each other. As a result, the driving force of the driving motor $M_2$ rotating in the direction of arrow 246 (FIG. 9) is transmitted respectively to the rotating drum 10 and the developing device 14 through the linking clutch 112 and the linking clutch member 246. Thus, the rotating drum 10 is rotated in the direction of arrow 12 (FIG. 2), in the developing device 14 the sleeve member 44 is rotated in the direction of arrow 42 (FIG. 2), and the first agitating mechanism 38 and the second agitating mechanism 40 are rotated in the directions of arrows 68 and 70 respectively (FIG. 2).

While the preferred embodiments of the electrostatic copying apparatus constructed in accordance with this invention have been described hereinabove with reference to the accompanying drawings, it should be understood that the invention is not limited to these specific embodiments, and various changes and modifications are possible without departing from the scope of the invention.

What is claimed is:

1. In an electrostatic copying apparatus of the type including a support frame having a front support wall and a rear support wall positioned with a predetermined space therebetween in the front and rear direction, said support frame being mounted on a housing for the apparatus so that the support frame is slidable in the front and rear direction of the frame between an operating position within the housing and a pull-out position outside of the housing, a rotating drum mounted on said support frame and having a photosensitive member disposed on the drum peripheral surface, and a developing device for developing a latent electrostatic image formed on the photosensitive member; the improvement wherein:

each of the rear surface of the front support wall and the front surface of the rear support wall in the support frame has a semicircular receiving portion having an open top, and each end of the rotating drum has mounted thereon a bearing member having a circular peripheral surface, each bearing member being insertable into an associated receiving portion from above to rotatably mount the rotating drum between the front support wall and the rear support wall of the support frame, and the developing device has a front wall and a rear wall positioned with a predetermined space therebetween in the front and rear direction, with a projecting portion formed at the end of each of the front wall and the rear wall, with an abutting lower edge defined at the lower edge of each projecting portion, an abutting front edge defined at the front edge of each of the front wall and the rear wall and below the respective projecting portion, and with the developing device mounted between the front support wall and the rear support wall with each abutting lower edge abutting against the upper surface of the associated bearing member when said associated bearing member is inserted into its associated receiving portion, and with each abutting front edge abutting against the side surface of the associated receiving portion, whereby each bearing member is prevented from moving away upwardly from its associated receiving portion and the developing device is held at a predetermined position with respect to the rotating drum.

2. The improvement of claim 1 wherein a circular opening is formed at a predetermined position in each of the front support wall and the rear support wall of the support frame, and each receiving portion comprises a receiving member having a main portion for insertion of the associated drum bearing member thereinto and a position-setting projecting portion having a circular peripheral surface corresponding to said circular opening and fixed to the associated one of the front support wall and the rear support wall to fix the receiving portion at a predetermined position.

3. The improvement of claim 2 wherein the projecting portion of at least that receiving member which is fixed to the rear support wall has formed therein a through opening extending in the front and rear direction, the rear end portion of the rotating drum has formed therein a linking hole extending forwardly from the rear end surface, and a linking clutch is disposed within the linking hole, so that when the support frame is caused to slide from the pull-out position to the operating position, the end portion of an input shaft disposed within the housing of the apparatus and extending in the front and rear direction is received in the linking hole through the through opening and the input shaft is drivingly connected to the rotating drum through the linking clutch.

4. The improvement of claim 1 wherein said abutting lower edge defined in the developing device extends substantially horizontally, said abutting front edge extends substantially vertically, and said receiving portion has formed therein a substantially vertical abutting surface against which said abutting front edge abuts.

5. The improvement of claim 1 wherein the developing device has a mounting projection at each of the front surface of the front wall and the rear surface of the rear wall, said support frame has a projecting receiving portion at each of the rear surface of the front support wall and the front surface of the rear support wall, and the developing device is mounted between the front support wall and the rear support wall of the support frame by mounting the mounting projection on the projecting receiving portion.

6. The improvement of claim 5 wherein the mounting projection has a circular peripheral surface, the projecting receiving portion is of an upwardly open semicircular shape, the mounting projection is inserted from above into the projecting receiving portion, and the projecting receiving portion is defined by a projecting receiving member mounted between the front support wall and the rear support wall so that its position can be adjusted freely in the horizontal direction.

* * * * *